US006315329B1

(12) United States Patent
Greene

(10) Patent No.: US 6,315,329 B1
(45) Date of Patent: Nov. 13, 2001

(54) METHODS FOR DETECTING FRAUDULENT INSTRUMENTS

(76) Inventor: Jonathan D Greene, 8016 Aberdeen Rd., Bethesda, MD (US) 20814

( * ) Notice: Subject to any disclaimer, the term of this patent is extended or adjusted under 35 U.S.C. 154(b) by 0 days.

(21) Appl. No.: 09/417,891

(22) Filed: Oct. 14, 1999

(51) Int. Cl.[7] ..... B42D 15/00
(52) U.S. Cl. ..... 283/67; 283/70
(58) Field of Search ..... 283/67, 70, 57, 283/58, 111, 72; 235/468, 469, 454, 439, 435

(56) References Cited

U.S. PATENT DOCUMENTS 4,588,211 * 5/1986 Greene ..... 283/70
4,634,149 1/1987 Greene .
4,724,309 2/1988 Greene .
5,456,498 * 10/1995 Greene ..... 283/70
5,650,248 * 7/1997 Miekka et al. ..... 283/70 X

* cited by examiner

*Primary Examiner*—Willmon Fridie, Jr.

(57) ABSTRACT

Methods for detecting fraudulent documents utilizing a plurality of fluorescent snippets on the document with other encryption data printed thereon with visible and invisible inks that becomes bright when subjected to certain light. The system combines visible and invisible data that is encrypted, totaled and when subjected to a algorithm will match a selected component of said data.

4 Claims, 2 Drawing Sheets

METHODS FOR DETECTING FRAUDULENT INSTRUMENTS

BACKGROUND OF THE INVENTION

Security instruments that have zones or snippets coated with fluorescent invisible inks are known to the prior art. Each zone or snippet will generally include an identification code, such as a binary code, to identify the individual snippets. Good examples of this technology can be understood by referring to the Edwin Greene patents; namely 4,634,184 dated Jan. 6, 1987; 4,724,309 dated Feb. 9, 1988; 4,588,211 and 5,418,853 of May 23, 1995.

With the advent of personal computers, sophisticated printers and scanners, the instances of bank fraud have increased dramatically. Relatively inexpensive computers with common printers can duplicate checks with great accuracy. It is a primary objective of this invention to confound those who would counterfeit checks and or who would alter or manufacture checks with such computer printer machines.

The technique of having identifiable snippets coated with invisible ultra violet ink or infrared ink has many important operational and security features. This invention provides security features which can be, but are not necessarily, employed with the Greene type checks.

In the art of bank fraud prevention, a Positive Pay service is an effective detection strategy. In this system, commercial customers send computer generated account files containing the MICR line data and the amounts of issued checks to their bank. When these checks are presented, the bank compares them with the data in the account files. The bank notifies the customers of any mismatches and the customer then tells the bank which checks to pay. As one can see, this system although effective, requires a significant effort from the bank and their customers.

Teller Line Positive Pay targets bad checks that are presented at the teller's windows. When tellers receive checks drawn on the customers account, they are compared against a customer's list of pre-authorized checks. The counterfeiter is caught before the check is cashed.

Also, there are devices and software where pattern recognition algorithms are used at the teller stations and/or in the check processing operations. For instance, software is available that will look for exceptional conditions such as duplicate serial numbers, out of range serial numbers or high dollar amounts when such amounts are not expected. Other technologies such as fingerprinting, iris scans and the like have been advanced but have met with limited success.

Many companies that issue hundreds or thousands of checks each month oftentimes utilize the aforementioned Positive Pay system. In these high volume systems, commercial customers send computer data containing MICR line data and the amount of all checks issued to their banks. The bank's computers automatically compare the checks with the data before payment.

FIELD OF INVENTION

The field of invention is in the use of invisible UV coated snippets upon which variable data is applied. The variable data, together with or without visible data, is entered by the check printer and the data is combined in a manner to present a plurality of obstacles to the professional or casual counterfeiter.

This invention, among its other advantages, will facilitate the use of Positive Pay services by reducing certain data to a single number. In this manner, it will make Positive Pay systems economically available to other than high volume issuers.

A principle objective of this invention is to provide a check fraud detection system that includes a plurality of UV sensitive zones or snippets on the check that contain encrypted data therein which is processed in a manner to authenticate the check with only minor involvement by the check maker.

An important objective of this invention is to print a 1 dimensional (D) or 2D bar-code on the document with either visible or invisible ink so that the history of a document can be traced in the event of a successful fraud. Bar codes can also include a wealth of other information.

Another objective of this invention is to deter would be counterfeiters with an array of intelligence on the checks, some visible and some not visible, so that the counterfeiter will be confused and make mistakes that will thwart the chance of success or facilitate capture by legal authorities.

Another objective of this invention is to allow the Bank of First Deposit or the Point of Sale to quickly determine if the check they are about to accept is a legitimate document so as to avoid the process and costs associated with fraudulent items.

Another important objective of this invention is to add supplemental machine readable information to a check so the paying bank has improved capability to automatically determine who the payee is, what reason the check was written for in the first instance and other data that can be used for marketing and security purposes.

In the course of the following description the following terms and their meanings will be used:

Maker: The person or company upon whose account the check is drawn. Also, known as the issuer.

Payee: The person to whom the instrument is to be paid.

Payor: Also, referred to as the "maker".

The Bank: The financial institution in which the maker has the funds.

Bank of first deposit: The bank to which the check is first presented.

Point of Sale: The first point the check is presented if not at a bank.

Check Printer: The actual printer of the check who supplies them to the maker.

UV Smart: Technology described in the Greene patents.

MICR: Magnetic Ink Character Recognition

If a counterfeit or altered check makes it past the teller or Point of Sale, there are several other strategies on the check that a merchant, a depository bank or the drawing bank can utilize to detect the bad check before payment.

Embodiments of the invention will now be explained by way of examples with reference to the drawings.

DESCRIPTION OF THE PREFERRED EMBODIMENT

Figure 1:
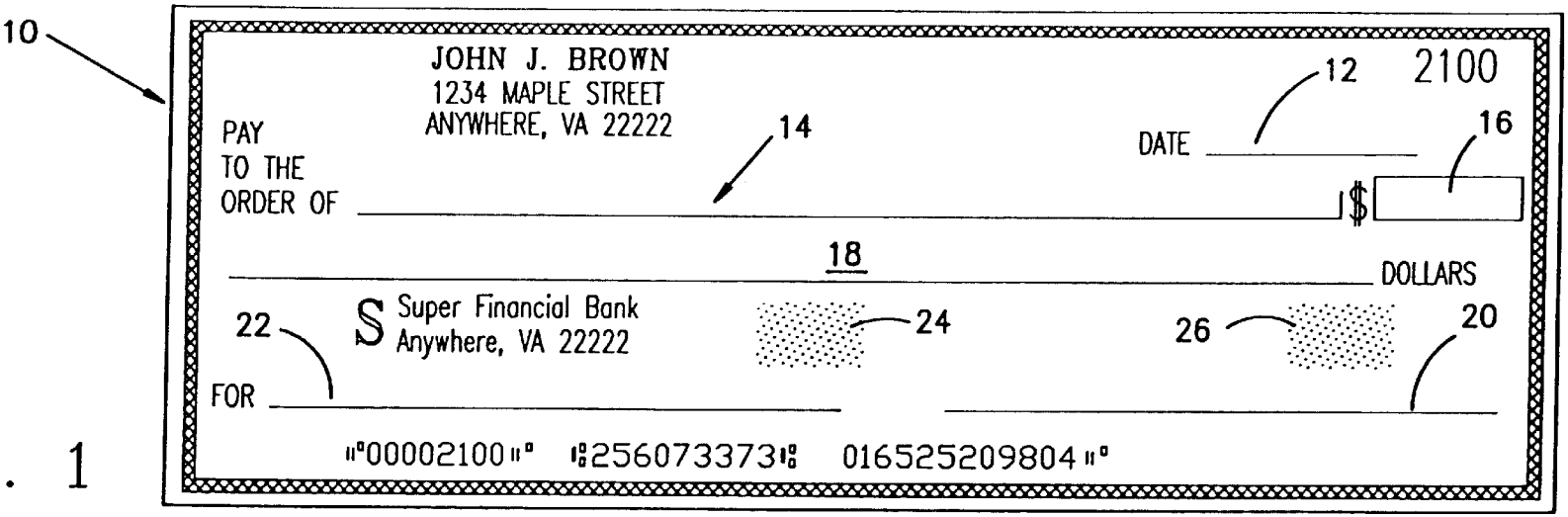
FIG. 1 is a plan view of the face of the check of this invention as seen by the naked eye.

Although, many advancements have been made via electronics for purposes of obligation payments, the check is still the favorite method by which consumers and business entities pay their bills. When paying by check, the payor is almost in complete control of when the funds will be withdrawn from his or her account. The check also provides a permanent record of the transaction and the issuer can examine the check when it is returned to determined whether the authorized checks have any alterations. Prior to this invention banks used various methods to detect fraud before honoring a fraudulent instrument. For instance, if the check is presented at a teller station, the signature and other methods of identification can be used to insure that the presenter is authorized. Also, Positive Pay systems can be commonly used.

As mentioned above, Positive Pay services remain effective detection strategies available at the present time. However, Positive Pay requires significant input by bank customers. Also, Positive Pay systems have an Achilles heel in that a counterfeiter can alter the payee's name only and the check will pass a Positive Pay system.

As explained in the aforementioned Greene patents, inks have been developed that are sensitive to ultra violet (UV) and/or infrared (IR) light. Sensitive inks are used to "paint" certain zones on the check. These zones are commonly known as snippets. These snippets may include the date, the payee, the courtesy amount, the legal amount, the signature and the memo line. In short, some or all information not included in the MICR line can be made to standout brightly on a check when it is exposed to UV or IR light. The snippets are detectable by UV or IR scanners on the check transport processing machines. These UV sensitive zones or snippets, when used with the teachings herein offer the possibility of a highly automated fraud detection system that requires little involvement or effort from the customer.

The UV inks used in the Greene system are invisible to the naked eye. Counterfeiters may not even know the coating is present when they try to copy or alter the checks. UV scanners are placed along the processing equipment that can quickly detect any smudging of the fluorescent ink. If an enterprising counterfeiter manages to create a similar fluorescent ink for coating snippets, his chance for a successful fraud are still slim if the processes taught herein are used or adopted. The technology described herein incorporates a variety of levels of security. The counterfeiter will not have access to the particular invisible fluorescent ink which will have a specified emission characteristic. Detectors along the check processing transport are provided that can verify the ink's authenticity. If a check is used that should have been coated with a fluorescent ink but is not coated, the system processing it will reject the physical document.

In one embodiment of the invention, an invisible or a visible 1D or 2D bar-code is printed on the check. Bar-codes can tell a great deal about the document. Bar-codes can identify the source of the paper, the printer, and if desired, such information as the usual amount over which the check should not exceed. Additionally, the visible intelligence and the invisible intelligence are encrypted and combined in a manner that will make it most difficult for even the most energetic counterfeiter. The technology described herein can enhance the automation of Positive Pay and will bring it within the reach of a wide range of banks and bank customers.

Figure 2:
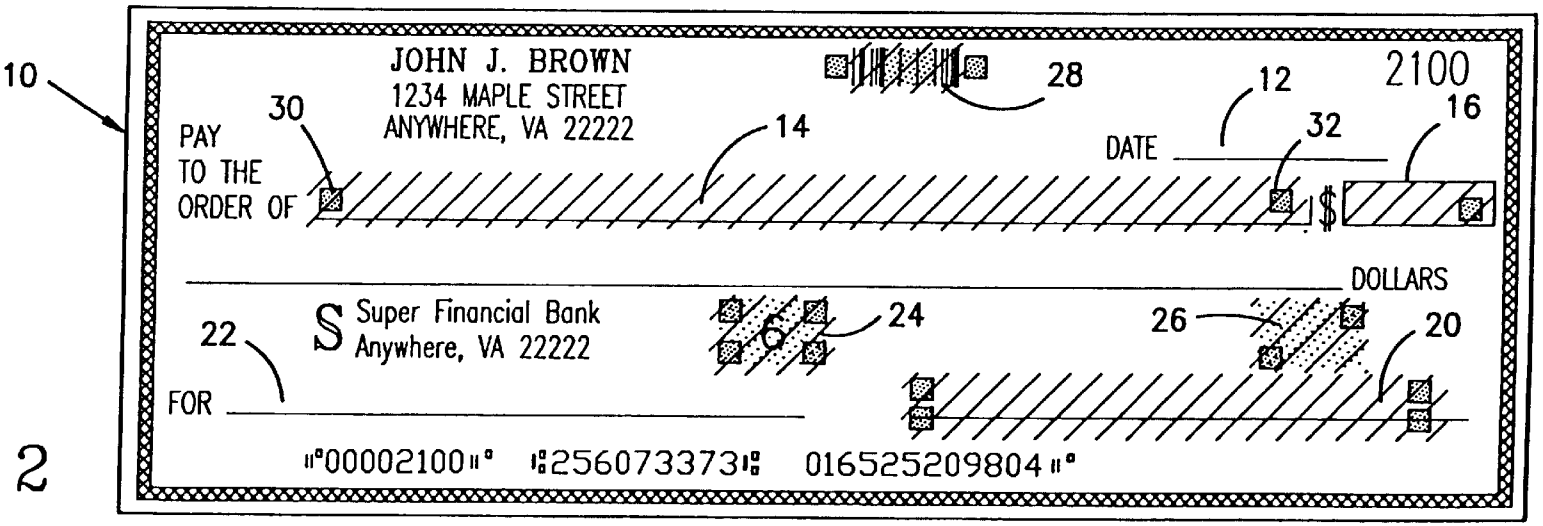
FIG. 2 is a view of the check of FIG. 1 as it appears when exposed to a UV light source prior to any entry of variable data by the payor.

Referring now to the drawings wherein like numerals indicate like elements, the numeral 10 indicates a check of a type that can incorporate the advantages and objectives of this invention. The check 10, as displayed in FIG. 1, is the view of a check by anyone by the naked eye. The check 10 has a date area 12, a payee area 14, a courtesy amount area 16, a written amount area 18, a signature area 20, and memo area 22. In addition to these common areas, the check has an area 24 that is shown by dots and an area 26 which is also shown by dots. The purpose of these areas, or snippets 24 and 26, will become more apparent hereinafter, When the check of FIG. 1 is exposed to a UV light source, the fluorescent ink coated selected snippets will cause them to appear as shown in FIG. 2. Note that the invisible bar code snippet 28 also becomes visible. Also note that snippet areas 14, 16, 20, 24 and 26 are illuminated because they are coated with the fluorescent ink. The small squares in each snippet are binary codes recognizable by processing machinery. For instance, note the binary code squares 30 and 32 on snippet 14. The binary code informs the computer of the snippet's significance; e.g. the payee line. This payee line snippet will be recognizable notwithstanding its location. The codes are not necessarily within the snippet areas. However, it has been found convenient to use a code within the snippets. For purposes of clarity, only codes 30 and 32 have been identified with numerals. Alternate codes, such as codes in the border decorations, can be used.

In the check of FIG. 2, there are six coated areas or snippets. The check printer will know the number of snippets and in the embodiment described, will print the numeral "6" in snippet 24. Actually, the fluorescent coating in snippet 24 will be an absence of ink for the numeral "6" and the binary code. Since only the fluorescent ink will glow, the numeral 6 is clearly exposed by the UV light. The binary codes are developed in the same manner. As will be seen, this invisible numeral is combined with other factors on the check for security purposes.

Figure 3:
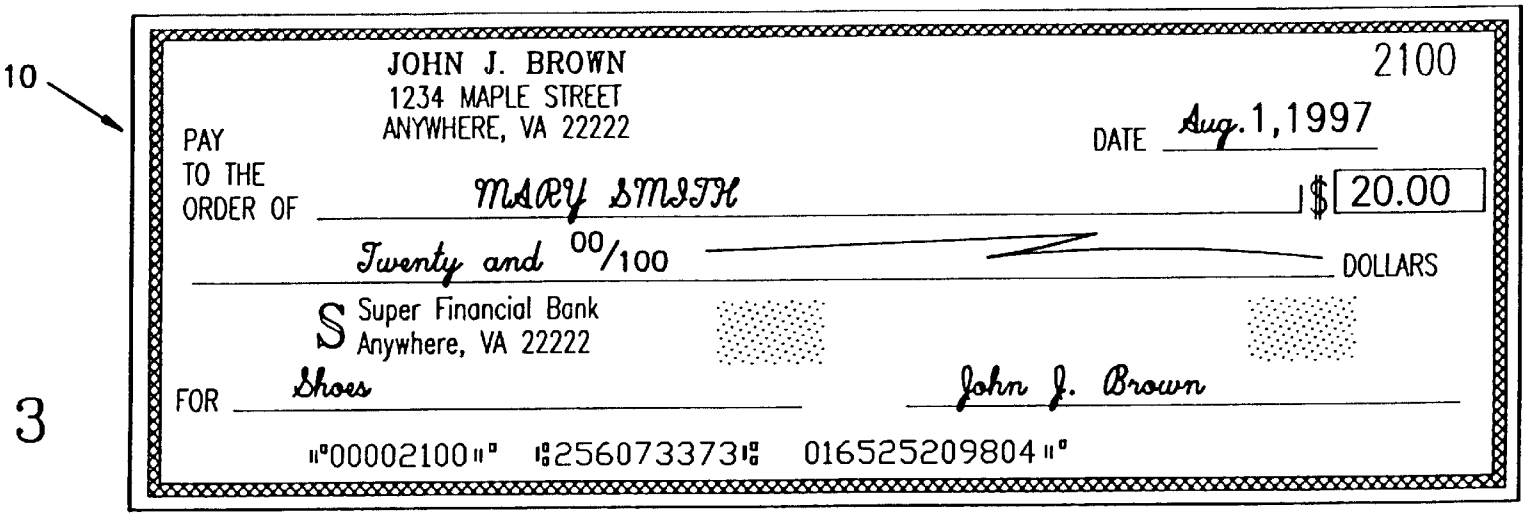
FIG. 3 is a plan view of the check of FIG. 2 by the naked eye after the payor enters the variable data.
Figure 4:
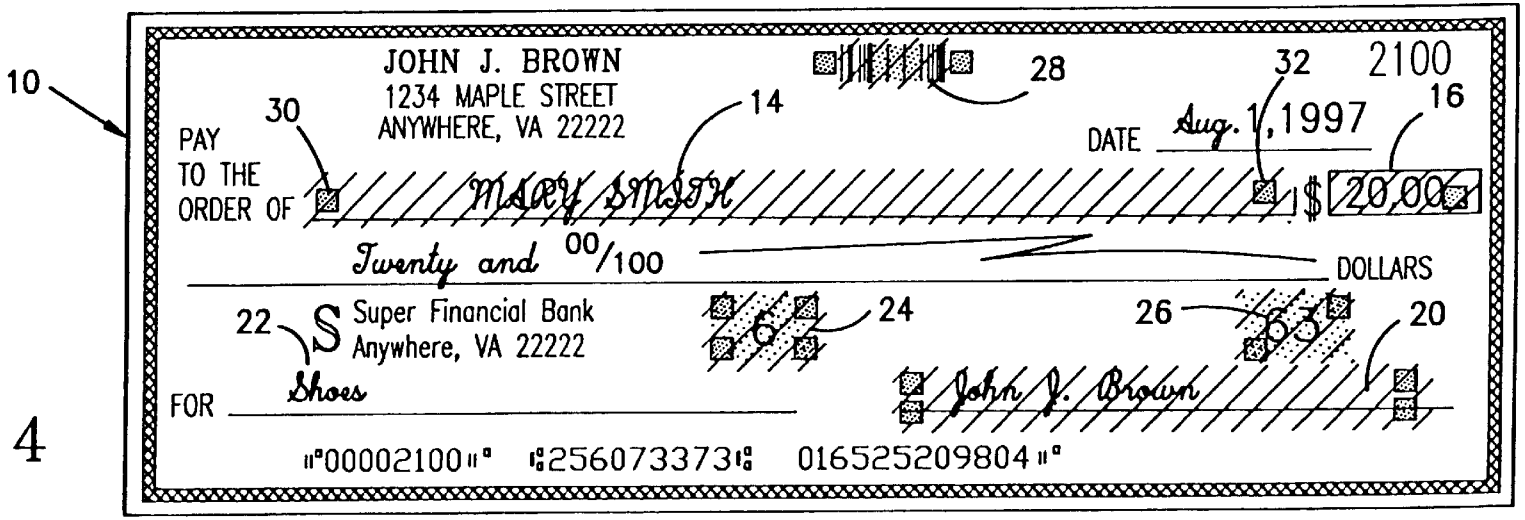
FIG. 4 is a view of the check of FIG. 3 as seen by the computer when the check is subjected to a UV light source.

In FIG. 3 there is shown the check of FIG. 1 with the variable data entered in snippets 12, 14, 16, 18 and 20 by the maker. The payee is shown as Mary Smith. A code can be set up that will assign a numerical value to each letter of the first word in the payee line. A very simple table or code is to give the letter A the value 1; the letter B the value 2; the letter C the value 3 etc. etc. until the letter Z is given the value of 26. With this simple formulation, the initial word MARY would have a numeric value of 57. This can be added to the number of snippets shown in area 24, that is 6. The snippet number is added to the numerical equivalent of MARY and that number is placed in snippet 26. Thus, the number "63" (6 +57) can be placed in the snippet 26 by the maker. Processing equipment can be provided to do this automatically. If desired, the number could be 657 rather than 63. In other words, the summation can be an assembly rather an addition.

The summation in snippet 26 can be the combination of many elements of the check other than just the first name of the payee line and the known number of snippets. These two items, one of which is variable with each check; e.g. the payee and one of which is the same e.g., the number of snippets for all of that makers' checks, are used for illustrative purposes. Even if the counterfeiter recognizes the number 6, he will have a very difficult time determining how the numeral 63 or 657 was computed especially if the data used is encrypted with sophistication.

There has been described above the most simple code that could be thought of for purposes of explanation. However, an algorithm is developed that includes the number of snippets combined with several scrambled letters and/or the variable can combine such features as the check number with portions of the payee. This data can also be scrambled. The result is readily solved and interpreted by a computer when the computer is equipped with the proper solving algorithm for the entering algorithm. In actual practice, the encrypted combination in snippet 26 will be four or five figure number rather than the two shown for ease of description.

As shown, the check has visible and invisible features that are combined in such a way to render it almost impossible for even the most experienced counterfeiter to duplicate. Additionally, invisible 1D or 2D bar-codes can be applied at the time of printing. Bar-codes can provide substantial amount of information regarding the check. The 2D bar-codes can give the source of the paper, the printer, the number of snippets and even the issuer. In the event of a successful fraud, a tracing can be followed provided by the clues that will aid in the capture of the perpetrator of the fraud. Additionally, the fluorescent ink printed bar-code can include data that is totaled with other material for a computation of the numeral to be placed in snippet 26.

As mentioned previously, this invention can be utilized with the teachings of the previously mentioned Greene patents. Those patents are incorporated herein by reference. For example, Greene '498 teaches a fluorescent ink that emits a known frequency when subjected to UV light. This emission of designed frequency can be accepted or rejected by a band pass filter. When such an ink is used, the counterfeiter must not only develop an ink having the same emission frequency but must also combine certain selected encrypted data know only to the issuer and to the processing bank. In the instant invention, the computer at the processing bank is equipped with an algorithm to solve any scrambled data. Thus, there has been developed a Positive Pay system that requires only a number from the issuer and the invention described herein will do the rest.

As mentioned above the formulations or algorithms for entering the data can be as complicated and/or relatively straightforward as desired provided the receiving bank (or point of) can interpret the data in snippet 26. In the positive pay system utilizing this invention, the bank customer, that is; the issuer, is not required to advise the bank that check 112 should have the numeral 63 for example in snippet 26. The algorithm known by the processing bank will read the number 63 into its computer. The solving algorithm will then flash the payee's name on its screen and the bank can be quite positive as to the documents legitimacy.

As stated, the bank at which the check is presented keys in the numeral 63 and on its computer a payee name will be flashed on the screen. A scanning of the check will show that Mary Smith was the payee and the check is processed in the regular manner. If a counterfeiter copied the check faithfully but inserted a different payee, for instance, John Doe, the algorithm or summation for John Doe will be radically different from Mary Smith and the bank will immediately alerted to the fraudulent nature of the check.

There has been described above, a combination of security features that are calculated to confuse and confound experienced counterfeiters by exposing them to visible and invisible features that will lead into mistakes that are detectable by check processing equipment. While there has been described a series of security features, it will be obvious to those of ordinary skill in the art that various changes and modifications can be made thereto without departing from the scope of the appended claims.

What is claimed is:

1. The method of detecting a fraudulent check comprising the steps of providing at least first, second, and third field areas on a check, coating at least one of said field areas with an invisible fluorescent ink, providing a code system that identifies each of said field areas, providing a first indicia in said first field area, providing a second indicia in said second fixed area, providing a first algorithm that combines said first and second indicia into a numerical summation, printing said numerical summations in said third field area.

2. The method of claim 1 including the further step of providing a second algorithm that interprets said first numeric indicia in its relationship to said numerical summation.

3. The method of claim 1 wherein said second indicia is provided by the printer of said check and said first indicia is entered by the maker of said check, and providing a payor bank with a solving algorithm that de-codes said numerical summation so that said payor bank can determine the correctness of said second indicia with its relationship to said first indicia.

4. The method of claim 1 including the step of providing an invisible bar code on said check with several components of information, and combining one and more of said components with other indicia on said check to establish said numerical summation.

* * * * *